United States Patent [19]

Geiger

[11] Patent Number: 4,591,063

[45] Date of Patent: May 27, 1986

[54] FLASK CLOSURE SYSTEM

[76] Inventor: Reinold Geiger, 38, rue de Longchamp, 92200 Neuilly sur Seine, France

[21] Appl. No.: 642,171

[22] Filed: Aug. 20, 1984

[30] Foreign Application Priority Data

Sep. 27, 1983 [FR] France ..... 83 15361
Jul. 6, 1984 [FR] France ..... 84 10839

[51] Int. Cl.[4] ..... B65D 41/04
[52] U.S. Cl. ..... 215/330; 215/331
[58] Field of Search ..... 215/330, 331, 347, 348

[56] References Cited

U.S. PATENT DOCUMENTS

| | | | |
|---|---|---|---|
| 3,786,954 | 1/1974 | Shull | 215/348 |
| 3,896,959 | 7/1975 | Roy | 215/348 X |
| 4,121,728 | 10/1978 | Tegalakis et al. | 215/347 X |
| 4,230,232 | 10/1980 | Atkins | 215/330 |
| 4,310,101 | 1/1982 | Sekine | 215/330 |
| 4,373,641 | 2/1983 | Banich et al. | 215/331 |
| 4,387,822 | 6/1983 | Lynn | 215/330 |

FOREIGN PATENT DOCUMENTS 2474451 7/1981 France .

*Primary Examiner*—Donald F. Norton
*Attorney, Agent, or Firm*—Kane, Dalsimer, Kane, Sullivan and Kurucz

[57] ABSTRACT

A closure system for a flask or a bottle made of glass and comprising a body (31) and a cylindrical tubular neck (32), the system comprising: a stopper (33) for fitting over the end of the neck, the stopper having a cylindrical tubular wall (35) and means (36, 37) for co-operating with the flask neck for sealing the flask; mutually co-operative guide means (39, 41, 42) on the neck and on the stopper for defining a combined motion of rotation and axial translation of the stopper relative to the neck; and stop means (55, 59) for limiting said motion in a predetermined closure position in which the stopper is at a desired orientation relative to the flask and in which sealing is ensured.

8 Claims, 6 Drawing Figures

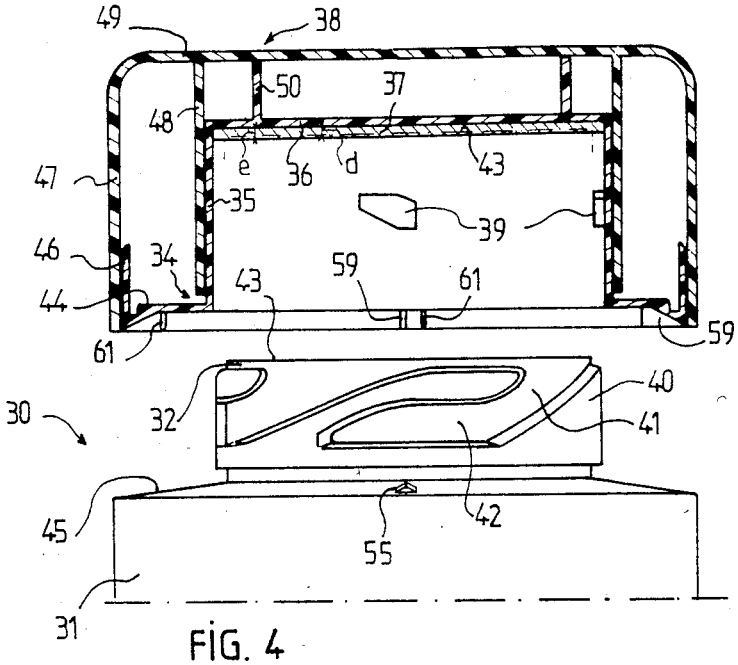
FIG. 4
FIG. 3
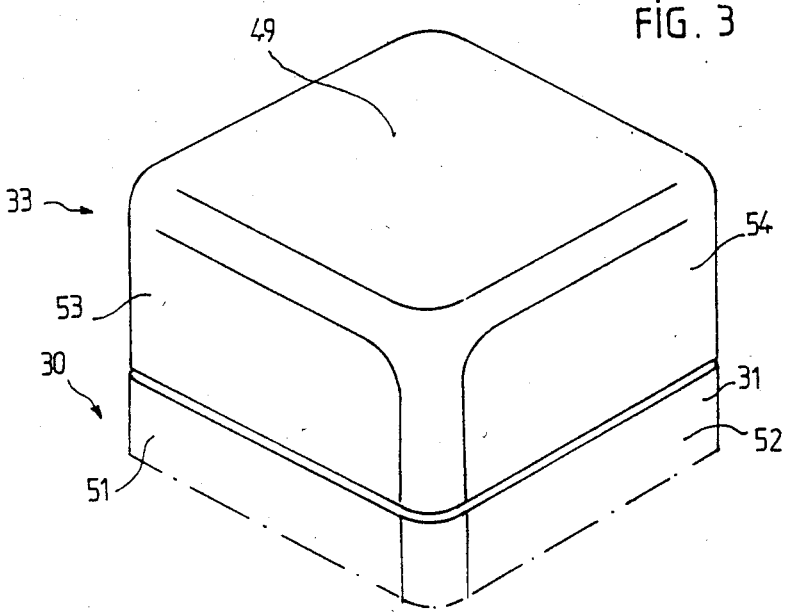

FLASK CLOSURE SYSTEM

The invention relates to a closure system for a necked flask or bottle, in particular for packaging products in the perfumery, cosmetics, pharmaceutical, food, etc. industries, with such a closure system comprising a stopper and means on the flask for co-operating with the stopper to close the flask.

BACKGROUND OF THE INVENTION

Closure systems are known which comprise a stopper in the form of a tubular body closed by an end disk which is placed over the neck of a bottle or flask that needs to be closed.

The closure is usually sealed by means of a sealing disk which is placed against an end wall of the stopper and which is compressed between the end wall of the stopper and the annular end of the bottle neck when the bottle is closed.

One of the oldest techniques consists in screwing the stopper onto the neck. In this case, the degree to which the sealing disk is compressed depends on the force exerted by the user each time the stopper is screwed onto the bottle neck. However, it has been observed that some users, in an effort to ensure proper sealing, tend to screw on the stopper too tight, thereby crushing the sealing disk and rapidly leading to its destruction.

In more recent techniques, the closed position corresponds to a relative position of the stopper and the neck which is theoretically well determined. This is the case when the stopper is fixed to the neck of the bottle by means of internally projecting lugs on the inside surface of the stopper engaging steeply sloping ramps or cam surfaces on the outside of the neck with end stops present to ensure that the stopper comes to rest in a predetermined angular relationship with the neck. This kind of system is essential if the stopper and the bottle neck are not of circular symmetry, eg. if they are of polygonal cross section for the sake of appearance or styling.

With respect to sealing, this technique theoretically has the advantage that the degree to which the sealing disk is compressed is independent of the force exerted by the user when the bottle closing. However, in practice, if the bottle is made of glass, conventional glass making techniques do not lend themselves, unfortunately, to small tolerances, in particular in the axial direction, between different portions of the neck of the bottle. There are thus considerable variations in the degree of sealing from one bottle to the next, due to the sealing disk being compressed by differing amounts.

Published French patent specification No. 2 471 926 proposes to solve this problem by providing a system in which the degree of sealing obtained in the closed position is independent of the relative axial position of the neck of the bottle and of the stopper. This system includes a flexible cylindrical skirt projecting from the end wall of the stopper into the bottle neck and coming into contact with the inside surface of the bottle neck.

However, it is not always easy to provide such a cylindrical skirt inside the stopper, in particular when the stopper is intended to fit small bottles or flasks.

SUMMARY OF THE INVENTION

It has been observed that for sealing a bottle or flask in the second manner described above, ie. with lugs and cams, sealing can be obtained as simply as with a screw stopper, ie. a stopper having a washer lining its end wall, by providing a washer made of highly elastic material which is thick enough to compensate for the variations in dimensions inherent to mass production of bottles.

Under these conditions, even if the washer is less compressed between the end surface of the neck and the end wall of the stopper during closing, sealing is ensured.

Up to the present, the end wall of a stopper has been lined with a thin disk or washer, while the present invention stems from the opposite idea of using a thick disk of highly elastic material, thus reaching a previously attainable result.

The present invention thus provides a closure system for a flask or a bottle made of glass and comprising a body and a cylindrical tubular neck, the system comprising:

a stopper for fitting over the end of the neck, the stopper having a cylindrical tubular wall closed at one end by an end wall and including a sealing washer capable of being elastically compressed between the said end wall and the annular end surface of the neck;

mutually co-operative guide means on the neck and on the stopper for defining a combined motion of rotation and axial translation of the stopper relative to the neck; and stop means for limiting said motion in a predetermined closure position in which the stopper is at a desired orientation relative to the flask and in which sealing is ensured;

and wherein the sealing washer is made of a material whose thickness and elasticity are so chosen in relation to the axial dimensional tolerances of the flask that in the closed position with the washer compressed between the end of the neck and the end wall of the stopper both the maximum in-tolerance compression to which the washer may be subjected does not exceed a value compatible with prolonged use, and the minimum in-tolerance compression to which the washer may be subjected is sufficient to ensure sealing.

Thus, by providing adequate thickness and compressibility for the washer (which is usually in the form of a disk) the unwanted side effects of the rather wide dimensional tolerances usual in glass making can be overcome, i.e. a closed flask always compresses its washer sufficiently to prevent leakage, but never so much as to permantently deform the washer.

The washer is preferably 0.8 to 2 mm thick with the optimum thickness usually being around 1.5 mm. The compressibility of the washer should be such as to enable the washer to tolerate a residual thickness in the closed position which may differ by as much as about 0.5 mm between extremes. The maximum reduction in thickness advantageously corresponds to elastic compression in the range 30% to 60%.

Not only are axial tolerances rather wide in glass flask manufacture, but angular tolerances are also rather wide. Thus, the angular position of the neck relative to the body of the flask may vary by as much as 2°, which means that the stopper angular position (which is fixed relative to the neck) may likewise vary by as much as 2° relative to the body.

Such inaccuracy does not matter in some forms of packaging, but in other forms this is not at all the case: some designs of flask have a body and a stopper with outside faces cylindrical outside face which are not of revolution about the axis of the neck, an at least some of the faces of the stopper should be flush with corresponding faces of the flask body. If the stopper faces are not properly positioned relative to the flask, the overall effect is unattractive.

To improve the accuracy of the stopper orientation relative to the flask body, the present invention also provides a closure system for a flask or a bottle made of glass and comprising a body and a cylindrical tubular neck, the system comprising:

a stopper for fitting over the end of the neck, the stopper having a cylindrical tubular wall and means for co-operating with the flask neck for sealing the flask;

mutually co-operative guide means on the neck and on the stopper for defining a combined motion of rotation and axial translation of the stopper relative to the neck; and stop means for limiting said motion in a predetermined closure position in which the stopper is at a desired orientation relative to the flask and in which sealing is ensured;

and wherein the said stop means for limiting the motion of the stopper includes surface discontinuities situated on the body of the flask and co-operating with surface discontinuities on the stopper.

By defining the angular position of the stopper relative to the body of the flask, rather than relative to the neck of the flask, any inaccuracy in flask manufacture relating to the relative position of the neck and the body is avoided, thus improving positioning of the stopper relative to the body.

The flask surface discontinuities may be situated on a shoulder that runs from the side faces of the body to the neck.

The guide means preferably include lugs projecting from the inside face of the cylindrical wall of the stopper and co-operating with helical grooves in the neck, or vice versa.

BRIEF DESCRIPTION OF THE DRAWINGS

Embodiments of the invention are described by way of example with reference to the accompanying drawings, in which:

FIG. 3 is a perspective view of a portion of an assembly constituted by a second flask and its stopper, and including a closure system in accordance with the invention;

FIG. 4 is a side view of the top of the flask shown in FIG. 3 shown underneath a section of the stopper taken on a line IV—IV of FIG. 5;

MORE DETAILED DESCRIPTION

Figure 1:
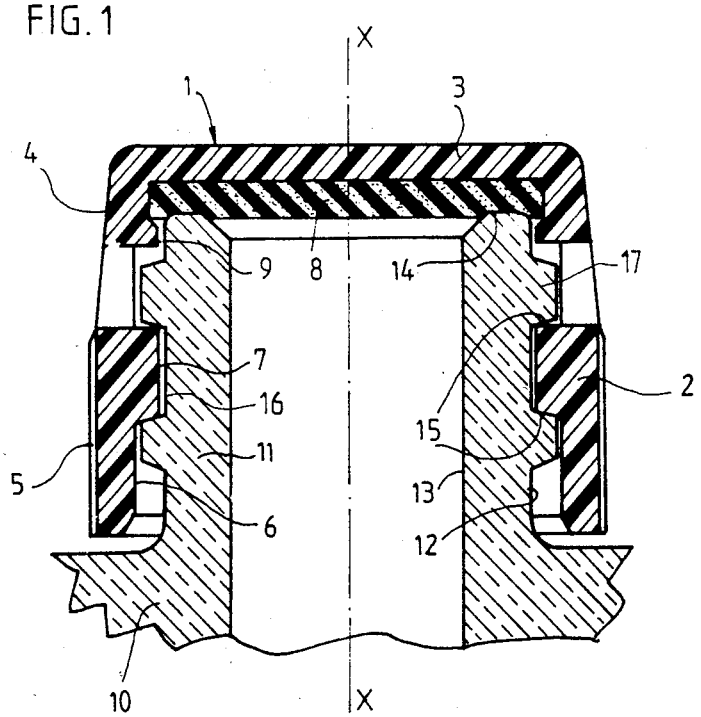
FIG. 1 is a section through the neck of a first flask fitted with its stopper.

The stopper 1 shown in FIG. 1 comprises a cylindrical tubular wall 2 and an end wall 3. The wall 2 has an outside surface 4 with fluting 5 that is parallel to the axis X—X of the stopper and which is intended to facilitate gripping the stopper. The stopper may either be directly gripped by the user for opening or closing the flask, or else the stopper may be gripped by an ornamental cover. The stopper also has an inside cylindrical face 6 from which lugs 7 project inwardly. These lugs are preferably shaped in the manner described in the above-mentioned French Patent specification No. 2 471 926.

A sealing disk 8 is placed against the inside surface of the end wall 3 and is described in detail below. The sealing disk 8 is held in place by any suitable means, eg. by glue. In the embodiment shown, the inside surface 6 of the cylindrical wall of the stopper has a circular rib 9 of smaller diameter than the disk 8, thereby helping to keep the disk 8 against the end wall 3.

The flask 10 has a neck 11 with a cylindrical outside surface 12, a cylindrical inside surface 13 and an annular end face 14. The outside face 12 has an outwardly projecting ridge 17 in which diametrically opposed and substantially helically shaped grooves 18 are formed.

Figure 2:
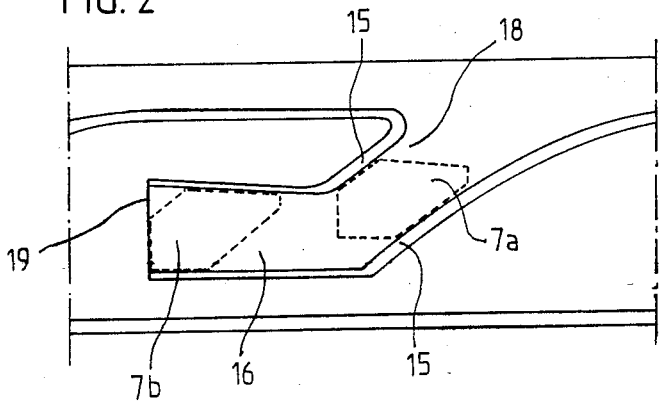
FIG. 2 shows a portion of the surface of the neck shown in FIG. 1 developed in a plane.

FIG. 2 shows half of the ridge 17 developed in a plane. One of the grooves 18 can be seen in full. It has sloping top and bottom sides 15 and is followed by a substantially horizontal portion 16 which, in fact, extends circumferentially around the axis X—X. The inside end face of a co-operating lug 7 is shown engaging the sloping groove 18 at *7a* and abutting against the end of the horizontal portion 19 at *7b*. The *7b* position corresponds to the position shown in FIG. 1.

As explained in the above-mentioned French patent specification No. 2 471 926 (to which reference may be made for full details) when the lugs 7 are guided along the grooves 18, there results a combined motion of rotation and translation of the stopper relative to the flask, with the translation coming to an end when the lugs engage the horizontal portion 16.

The sealing washer or disk 8 is then compressed to a predetermined residual thickness.

The sealing disk 8 is made of elastomer material in the form of a foam having closed pores, and its thickness is chosen as a function of the axial manufacturing tolerances of the flask neck.

It is thus possible to ensure that the depth to which the sealing disk 8 is compressed between the annular end face 14 and the end wall 3 lies somewhere in a range extending between a minimum amount of compression to ensure adequate sealing and a maximum amount of compression which still provides adequate sealing but which avoids crushing the sealing disk to an extent which could shorten its service life.

The resulting seal is consequently independent of the manufacturing tolerances on the neck of the flask, and the seal remains satisfactory even after a large number of opening and closing operations.

By way of example, the sealing disk may be made of polypropylene foam. Alternatively it may be made of polyethylene foam.

The surface of the sealing disk facing the neck may be treated in a special manner, eg. by glazing, or by being given a suitable covering.

The assembly shown in FIGS. 3 and 4 comprises a glass flask 30 in the form of a body 31 and a neck 32, and a stopper 3. The stopper is made of three parts of synthetic material: a stopper body 34 comprising a tubular cylindrical wall 35 and an end wall 36; a sealing washer 37 in the form of a polyolefin foam disk; and a cover 38. The body 34 of the stopper and the sealing disk 37 which is pressed against the end wall 36 co-operate with the neck 32 of the flask to close the flask as shown in FIG. 3. To do this, the cylindrical wall 35 has four inwardly projecting lugs 39, while the neck 32 has an outwardly projecting ridge 40 in which four helical grooves 41 for receiving the lugs. The helical grooves 41 end in horizontal portions 42.

When the stopper is applied to the neck of the flask and is turned righthandedly, the lugs 39 engage the grooves 41 and the rotary motion of the stopper is accompanied by axial translation towards the flask body. Once the lugs reach the horizontal portions 42, the rotary movement continues until it is stopped in a manner described below, but axial translation is stopped directly. The annular end face 43 of the neck 32 is then at a predetermined distance d from the end wall 36 of the stopper, as indicated in FIG. 4 by a dashed line 43. The end face is then pressed against the smooth face of the sealing washer 37 leaving a residual washer thickness d which is smaller than its initial thickness e. Given the tolerances inherent to glass flask manufacture, the distance d is determined with an inaccuracy of about 0.5 mm. Thus, the initial thickness e (which is about 1.5 mm) and the compressibility of the disk 37 are chosen to be adequate to ensure that the residual thickness d may vary over about 0.5 mm while still ensuring closure sealing without permanently deformation of the sealing disk.

The body 34 of the stopper 33 has an outwardly directed plate 44 at the bottom of its cylindrical wall 35 extending substantially horizontally above the shoulder 45 which connects the neck 32 to the side faces of the flask body 31. The outer periphery of the plate 44 ends in an upwardly directed rim 46. The cover 38 has an outer wall 47 which fits over the rim 46 and it also has a skirt 48 projecting axially inwardly from a top wall 49 which fits over the cylindrical wall 35 of the stopper body 34. The top wall 49 of the cover bears against a brace 50 which projects upwardly from the end wall 36 of the body 34. The cover 38 is provided for appearance' sake and to enable the user to grasp the stopper.

As can be seen in FIG. 3, the assembly constituted by the flask and its stopper has the outward appearance of a square section bar or prism. In particular, it can be seen that two sides 51 and 52 of the flask body are sustantially coplanar with two sides 53 and 54 respectively of the stopper. The stopper sides 53 and 54 are parts of the outer wall 47. It can thus be seen that an angular offset of a few degrees between the stopper and the flask body would be unattractive in appearance because of the poor alignment of the faces that are supposed to be coplanar.

The invention provides means for ensuring that the stopper is at a desired angle when in the closed position.

Figure 5:
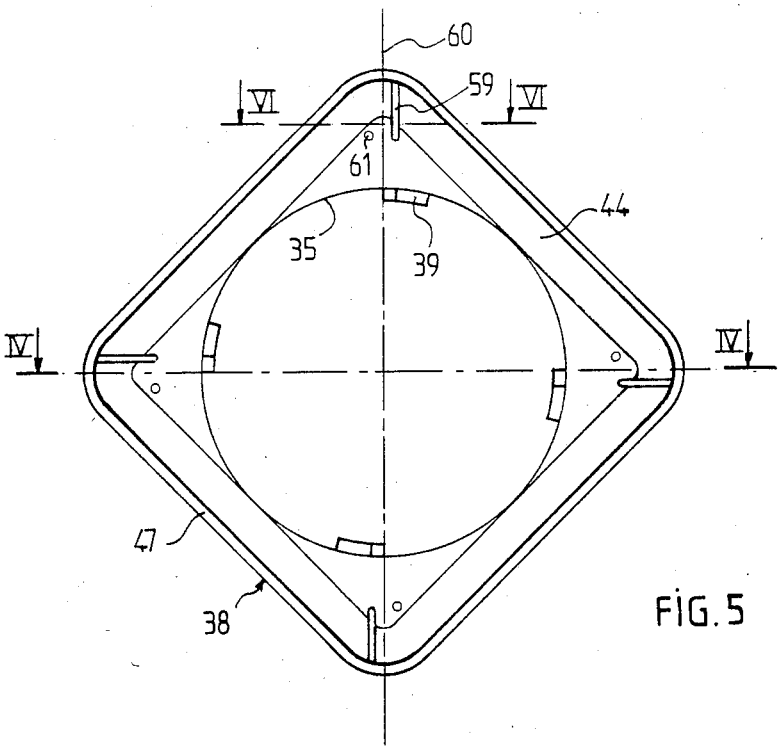
FIG. 5 is an underside view of the stopper shown in FIG. 4.
Figure 6:
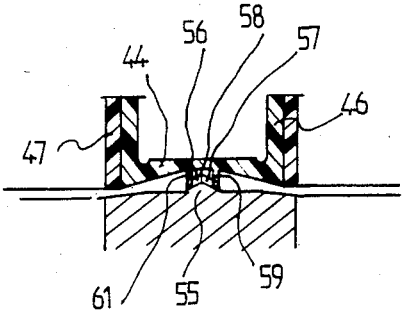
FIG. 6 is a section on a line VI—VI of FIG. 5.

These means comprise two ribs 55 situated on the shoulder 45 of the flask at two opposite corners thereof, said ribs projecting upwardly towards the plate 44 of the stopper. One of these ribs 55 is visible in FIGS. 4 and 6 and has two faces 56 and 57 at an angle to the shoulder 45 sloping down, roof-like, from a central ridge 58. Each rib 55 is intended to co-operate with a rib 59 projecting down from the stopper plate 44. Four such ribs 59 are provided on the stopper, one at each corner. One or other of the diagonally opposite pairs of ribs 59 are thus used on any one occasion to engage the ribs 55 on the flask, which may engage the stopper in four distinct positions at 90° intervals about the axis X—X. As can be seen in FIG. 5, each rib 59 is sligh offset from the diagonal 60 of the stopper and runs generally parallel thereto. Thus, in the closed position, the rib 59 abuts against the sloping face 57 of the rib 55 with the ridge 58 being directly opposite the diagonal 60. A resiliently deformable stud 61 is provided adjacent to each rib 59, but on the other side of the diagonal 60. The studs 61 project downwards as do the ribs 59. As the flask is being closed, the studs 61 deform resiliently to pass over the ribs 55 so that they engage the other sloping faces 56 thereof, while the ribs 59 abut firmly against the sloping sides 57. The angle of the stopper relative to the flask body is thus secured by the flask ribs 55 being resiliently gripped between cooperating ribs 59 and studs 61.

The means described with reference to FIGS. 3 to 6 for ensuring that the stopper has a predetermined orientation relative to the body of the flask may be used in conjunction with sealing means other than those described above, for example a skirt on the stopper could co-operate with the bore of the neck as described in the above-mentioned French patent specification No. 2 471 926.

I claim:

1. A flask device to contain, in particular, perfumes or cosmetic products comprising:

a flask body having a longitudinal axis:

a neck having an end surface and being connected to said body:

a closure system with a sealing washer facing said end surface;

a first guide means disposed on said neck;

a second guide means disposed on said closure systems;

one of said first and second guide means comprising a helical ramp cooperating with the other guide means to translate said closure system in a preselected direction in parallel with said axis with respect to said flask body while said closure is rotated to apply pressure to said washer, said ramp ending in a portion perpendicular to said axis;

whereby during rotation corresponding to said portion the pressure on the washer remains constant; and securing means disposed on said body and closure system for interengaging said closure system and body in a predetermined relationship when said closure reaches a preselected position as it is rotated along said portion; wherein the body of the flask is connected to the neck by a shoulder with at least a rib projecting upwards relative to the shoulder having two operative faces, cooperating means on a plate of the closure, the cooperating means of the plate of the closure including first means for cooperating with the one operative face and second means for cooperating with the other operative face, and said first means are adapted to resiliently yield when said rib moves past it, and said second means is also a rib.

2. The flask according to claim 1, in which the helical ramp is on the neck.

3. The flask according to claim 2, in which said helical ramp is hollow and forms a groove, and the second guide means is in the form of a lug.

4. The flask according to claim 3, in which the helical groove is followed by a horizontal groove.

5. The flask according to claim 3 in which the lug has an oblique surface in order to cooperate with the helical ramp and a horizontal surface to cooperate with the horizontal groove.

6. The flask according to claim 1, in which the sealing washer is made of an elastic material and is sufficiently deformable and of sufficient thickness to ensure the sealing by the washer when said flask body has manufacturing irregularities.

7. The flask according to claim 1, in which the operative faces form a ridge.

8. The flask according to claim 1 in which said closure rib forms a rigid blade.

* * * * *